US008864605B2

(12) United States Patent
Iizuka et al.

(10) Patent No.: US 8,864,605 B2
(45) Date of Patent: Oct. 21, 2014

(54) COLORED GOLF BALL

(75) Inventors: Kae Iizuka, Chichibushi (JP); Eiji Takehana, Chichibushi (JP); Hiroyuki Nagasawa, Chichibushi (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 362 days.

(21) Appl. No.: 13/222,251

(22) Filed: Aug. 31, 2011

(65) Prior Publication Data

US 2012/0122614 A1 May 17, 2012

(30) Foreign Application Priority Data

Nov. 15, 2010 (JP) ..... 2010-255109

(51) Int. Cl.

| | |
|---|---|
| ***A63B 37/12*** | (2006.01) |
| ***A63B 37/00*** | (2006.01) |
| ***A63B 43/00*** | (2006.01) |
| *A63B 37/06* | (2006.01) |

(52) U.S. Cl.

CPC ..... *A63B 37/0013* (2013.01); *A63B 37/0022* (2013.01); *A63B 43/008* (2013.01); *A63B 37/0097* (2013.01); *A63B 37/0076* (2013.01)

USPC ..... 473/378; 473/377

(58) Field of Classification Search

USPC ..... 473/350–378

See application file for complete search history.

(56) References Cited

U.S. PATENT DOCUMENTS

| | | | | |
|---|---|---|---|---|
| 5,952,415 | A * | 9/1999 | Hwang | 524/399 |
| 6,306,968 | B1 * | 10/2001 | Bellinger et al. | 525/179 |
| 6,336,870 | B1 | 1/2002 | Kato et al. | |
| 6,435,984 | B1 | 8/2002 | Ohama | |
| 6,986,718 | B2 * | 1/2006 | Ohama et al. | 473/373 |
| 7,291,076 | B2 * | 11/2007 | Watanabe | 473/378 |
| 7,568,986 | B2 * | 8/2009 | Watanabe et al. | 473/378 |
| 7,572,195 | B2 * | 8/2009 | Egashira et al. | 473/351 |
| 7,744,494 | B2 * | 6/2010 | Jordan et al. | 473/378 |
| 8,460,125 | B2 * | 6/2013 | Nagasawa et al. | 473/378 |
| 2009/0054176 | A1 | 2/2009 | Isogawa et al. | |
| 2010/0004072 | A1 | 1/2010 | Komatsu et al. | |

FOREIGN PATENT DOCUMENTS

| | | | | |
|---|---|---|---|---|
| JP | 2000024139 | A * | 1/2000 | A63B 37/12 |
| JP | 2000-254250 | A | 9/2000 | |
| JP | 3649568 | B2 | 5/2005 | |
| JP | 2007-144097 | A | 6/2007 | |

(Continued)

OTHER PUBLICATIONS

Japanese Patent Office, "Notification of Reason(s) for Refusal," issued in connection with Japanese Patent Application No. 2010-255109, dated Mar. 11, 2014.

*Primary Examiner* — Alvin Hunter

(74) *Attorney, Agent, or Firm* — Sughrue Mion, PLLC

(57) ABSTRACT

In a colored golf ball having a core, a cover of two or more layers encasing the core, and a coat of paint applied to a surface of an outermost layer of the cover, the outermost cover layer is formed of a resin composition which includes (a) a thermoplastic resin, (b) a fluorescent color-containing color pigment and/or dye, and (c) titanium oxide. A layer adjoining an inner side of the outermost layer is formed of a resin composition containing a resin. The colored golf ball has an excellent rebound and weatherability, and also is endowed with a high brightness and a sense of quality and elegance.

12 Claims, 1 Drawing Sheet

(56) References Cited

FOREIGN PATENT DOCUMENTS

| | | | |
|---|---|---|---|
| JP | 2009-045347 | A | 3/2009 |
| JP | 2010012250 | A | 1/2010 |
| JP | 2010154971 | A | 7/2010 |

* cited by examiner

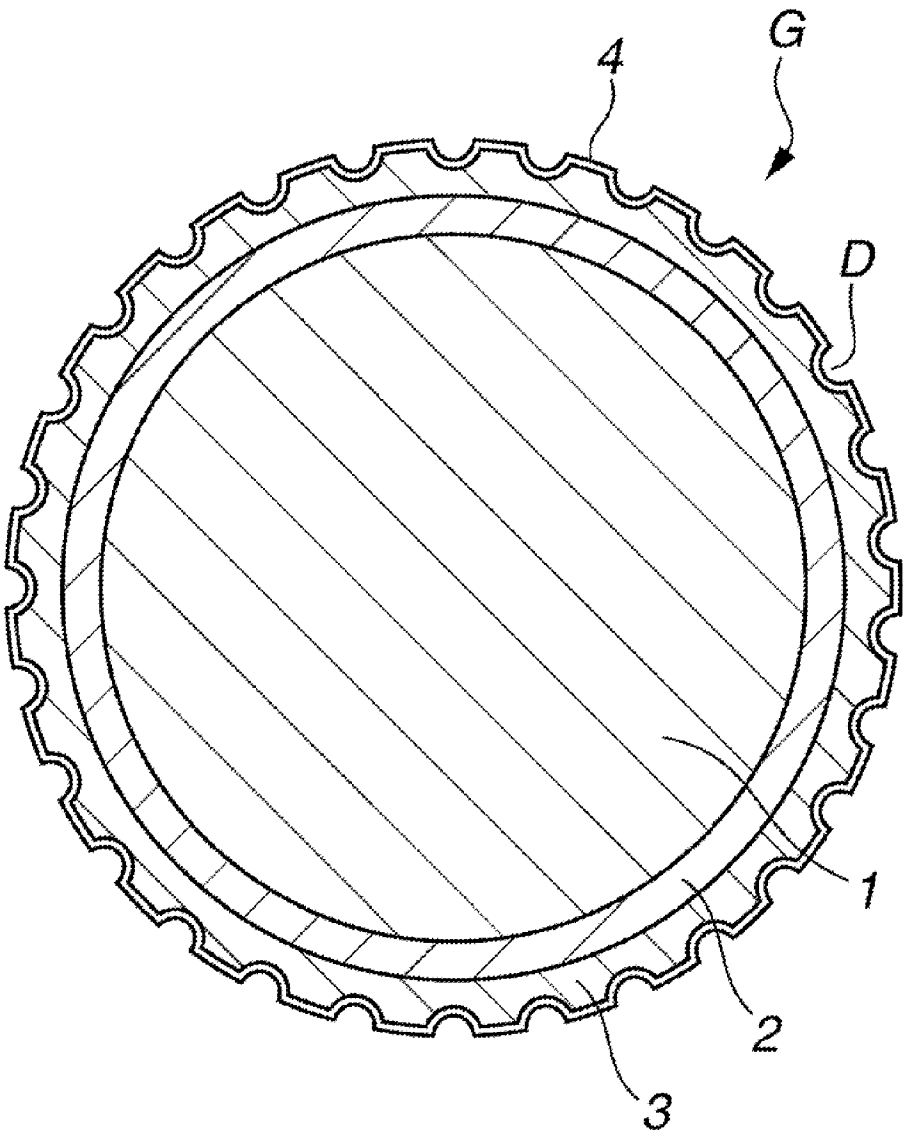
G
4
D
1
2
3

COLORED GOLF BALL

CROSS-REFERENCE TO RELATED APPLICATION

This non-provisional application claims priority under 35 U.S.C. §119(a) on Patent Application No. 2010-255109 filed in Japan on Nov. 15, 2010, the entire contents of which are hereby incorporated by reference.

TECHNICAL FIELD

The present invention relates to a colored golf ball which has an excellent rebound and weatherability, and also is endowed with a high brightness and a sense of quality and elegance.

BACKGROUND ART

Not all golf balls lately are white; colored balls in a variety of colors have appeared on the market in response to golfers' preferences. In particular, stylish colored golf balls having an elegant feel are being developed to suit the tastes of women golfers.

Many colored balls with an elegant appearance currently sold on the market combine a fluorescent colored outermost layer with a polarizing pigment-containing paint. More casual, pastel-colored golf balls are also available on the market.

In order to create a sense of quality and elegance in a golf ball, it is generally common to include a fluorescent pigment or a fluorescent dye in the cover-forming material. However, such fluorescent pigments and dyes undergo major discoloration with exposure to ultraviolet light (weathering), leading to changes in the appearance of the ball in a short time and thereby making a sense of elegance difficult to maintain.

At the same time, there is a tendency for the ordinary consumer to desire such highly stylish colored golf balls to have the same high rebound and distance performance as conventional white golf balls. In general, to obtain a good distance performance, an ionic resin having an excellent rebound is used in an inner layer (intermediate layer). However, balls in which the intermediate layer is formed using an ionic resin tend to have a lower brightness and a more somber color. Hence, the ball has an increased rebound, but retaining a sense of quality and elegance has been difficult. Moreover, when a white pigment (titanium oxide) is added to a clear resin so as to keep the somber color of the intermediate layer from emerging on the surface of the ball, the opacity increases. Such an opacity also tends to detract from the sense of elegance in terms of the color appearance. The result is a pastel color tone, and imparting a sense of elegance to such a color is very difficult. Therefore, it has not been possible to achieve both a sufficient distance performance and stylishness in the same golf ball.

Accordingly, there exists a desire for the development of a golf ball which, even in cases where an intermediate layer made of an ionic resin is used in order to increase the ball rebound, is able to maintain a high brightness and also is endowed with a good rebound, weatherability and a sense of elegance.

Examples of the prior art relating to colored golf balls include JP-A 2000-254250, JP 3649568, JP-A 2007-144097 and JP-A 2009-45347 (and the corresponding U.S. Pat. application Ser. No. 2009-54176). However, none of these publications describe colored golf balls having a good rebound, a good durability and a sense of quality and elegance.

SUMMARY OF THE INVENTION

It is therefore an object of the present invention to provide a colored golf ball which has an excellent rebound and weatherability, and also is endowed with a high brightness and a sense of quality and elegance.

The inventors have discovered that, by forming an outermost cover layer of a specific resin composition containing a fluorescent color-containing color pigment and/or dye and containing also a small amount of titanium oxide, by forming a layer adjoining an inner side of the outermost layer of a resin composition which includes an ionic resin having a specific weight-average molecular weight (Mw) and a specific weight-average molecular weight (Mw) to number-average molecular weight (Mn) ratio (Mn/Mw), and by applying thereon a polarizing pigment-containing paint so as to form a paint coat, there can be obtained a golf ball which has an excellent rebound and weatherability, and also is endowed with a high brightness and a sense of quality and elegance.

Accordingly, in a first aspect, the invention provides a colored golf ball composed of a core, a cover of two or more layers encasing the core, and a coat of paint applied to a surface of an outermost layer of the cover. The outermost cover layer is formed of a resin composition which includes (a) 100 parts by weight of a thermoplastic resin, (b) 5 parts by weight or less of a fluorescent color-containing color pigment and/or dye, and (c) 0.45 part by weight or less of titanium oxide. A layer adjoining an inner side of the outermost layer is formed of a resin composition containing 100 parts by weight of a resin component which includes: (A) an ionic resin having a weight-average molecular weight (Mw) of at least 40,000 and a weight-average molecular weight (Mw) to number-average molecular weight (Mn) ratio (Mn/Mw) of at least 3.0, and having at least 70 wt % of unsaturated carboxylic acid present therein neutralized with metal cations, and (B) a thermoplastic resin other than component A in a component A to component B weight ratio (A/B) of from 100/0 to 10/90; and containing also (C-1) 5 parts by weight or less of a color pigment or dye. The ball has a surface luminance of from 5 to 100 cd/m$^2$.

In a second aspect, the invention provides a colored golf ball composed of a core, a cover of two or more layers encasing the core, and a coat of paint applied to a surface of an outermost layer of the cover. The outermost cover layer is formed of a resin composition which includes (a) 100 parts by weight of a thermoplastic resin, (b) 5 parts by weight or less of a fluorescent color-containing color pigment and/or dye, and (c) 0.45 part by weight or less of titanium oxide. A layer adjoining an inner side of the outermost layer is formed of a resin composition containing 100 parts by weight of a resin component which includes: (A) an ionic resin having a weight-average molecular weight (Mw) of at least 40,000 and a weight-average molecular weight (Mw) to number-average molecular weight (Mn) ratio (Mn/Mw) of at least 3.0, and having at least 70 wt % of unsaturated carboxylic acid present therein neutralized with metal cations, and (B) a thermoplastic resin other than component A in a component A to component B weight ratio (A/B) of from 100/0 to 10/90; and containing also (C-2) from 1 to 20 parts by weight of a color masterbatch. The ball has a surface luminance of from 5 to 100 cd/m$^2$.

Preferably, the color pigment or dye (b) is selected from the group consisting of red pigments and dyes, blue pigments and dyes, yellow pigments and dyes, green pigments and dyes, violet pigments and dyes, and black pigments and dyes.

The colored golf ball preferably has a surface luminance of preferably from 10 to 85 cd/m$^2$.

The outermost layer-forming resin composition has a haze of preferably from 75 to 100.

The outermost layer-forming resin composition has a total light transmittance of preferably from 5.0 to 80.

The outermost layer-forming resin composition preferably has a diffuse transmittance of from 0.05 to 80.

Preferably, the paint coat includes 100 parts by weight of a base resin, from 0.05 to 1 part by weight of a fluorescent whitener and 3 parts by weight or less of a polarizing pigment, and the fluorescent whitener and polarizing pigment have a weight ratio therebetween of from 0.05 to 5.0.

ADVANTAGEOUS EFFECTS OF INVENTION

The invention is able to provide a colored golf ball having a rebound and weatherability which are both of a degree of excellence not previously achieved in conventional colored golf balls, and also endowed with a high brightness and a sense of quality and elegance.

BRIEF DESCRIPTION OF DIAGRAM

FIG. 1 is a schematic cross-sectional view of a golf ball according to one embodiment of the present invention.

DESCRIPTION OF EMBODIMENTS

The objects, features and advantages of the invention will become more apparent from the following detailed description, taken in conjunction with the foregoing diagram.

In the colored golf ball of the invention, the outermost layer of the cover is formed of a specific resin composition which includes a fluorescent color-containing color pigment and/or dye, and a small amount of titanium oxide. A layer adjoining an inner side of the outermost layer is formed of a resin composition which includes an ionic resin having a specific weight-average molecular weight (Mw) and a specific weight-average molecular weight (Mw) to number-average molecular weight (Mn) ratio (Mn/Mw), and in which the unsaturated carboxylic acid content (acid content) has been adjusted within a specific range. In addition, a coat of paint has been formed by applying a polarizing pigment-containing paint to the outermost layer.

The construction of the inventive golf ball, insofar as it includes a core and a cover of two or more layers, and the cover has an outermost layer with a coat of paint on the surface thereof, may be suitably selected within a range that allows the objects of the invention to be achieved. For example, in the case of a three-piece solid golf ball having a two-layer cover composed of an inner cover layer (intermediate layer) and an outer cover layer (outermost layer), as shown in FIG. 1, the golf ball G may have a three-piece structure composed of at least a core 1, an inner cover layer (intermediate layer) 2 encasing the core 1, and an outer cover layer 3 (outermost layer) encasing the inner cover layer 2, and may have also thereon a paint coat 4. A plurality of dimples D are generally formed on the surface of the outer cover layer 3 serving as the outermost layer. Although FIG. 1 shows a construction in which a core 1, an intermediate layer 2 and an outermost layer 3 are formed as a three-layer structure, as noted above, this construction may be suitably varied within a range that allows the objects of the invention to be achieved. For example, if necessary, use may be made of a construction wherein the cover has three or more layers, including two or more intermediate layers 2. It is also possible to form the core 1 as a plurality of layers. The colored golf ball is described in detail below while referring to FIG. 1.

The core 1 may be obtained by vulcanizing a rubber composition prepared by blending a known rubber material such as cis-1,4-polybutadiene as the base together with a co-crosslinking agent (e.g., an unsaturated carboxylic acid or a metal salt thereof), an inorganic filler (e.g., zinc oxide, barium sulfate) and an organic peroxide (e.g., dicumyl peroxide, 1,1-bis(t-butylperoxy)cyclohexane). In the present invention, no particular limitation is imposed on the core diameter. Nor is any particular limitation imposed on the color of the core.

The intermediate layer 2, which is here a layer adjoining an inner side of the outermost layer 3, is formed of a resin composition containing 100 parts by weight of a resin component which includes: (A) an ionic resin having a weight-average molecular weight (Mw) of at least 40,000 and a weight-average molecular weight (Mw) to number-average molecular weight (Mn) ratio (Mn/Mw) of at least 3.0, and having at least 70 wt % of unsaturated carboxylic acid present therein neutralized with metal cations, and (B) a thermoplastic resin other than component A in a component A to component B weight ratio (A/B) of from 100/0 to 10/90; and containing also (C-1) 5 parts by weight or less of a color pigment or dye.

Alternatively, the intermediate layer 2 is formed of a resin composition containing 100 parts by weight of a resin component which includes: (A) an ionic resin having a weight-average molecular weight (Mw) of at least 40,000 and a weight-average molecular weight (Mw) to number-average molecular weight (Mn) ratio (Mn/Mw) of at least 3.0, and having at least 70 wt % of unsaturated carboxylic acid present therein neutralized with metal cations, and (B) a thermoplastic resin other than component A in a component A to component B weight ratio (A/B) of from 100/0 to 10/90; and containing also (C-2) from 1 to 20 parts by weight of a color masterbatch.

The intermediate layer 2 is generally formed as a layer adjoining an inner side of the outermost layer 3, although it may be understood here to include also cases in which one or more transparent layer is formed between the outermost layer 3 and the intermediate layer 2. This intermediate layer 2, as mentioned above, may be formed as two or more layers using similar or dissimilar materials, depending on the ball specifications and other considerations. In cases where the intermediate layer 2 is formed of two or more layers (that is, where the overall cover is formed of three or more layers), the layer or layers to the inside of the layer (intermediate layer 2) adjoining the inner side of the outermost layer 3 may be formed primarily of a resin material of any of various types of thermoplastic resins or thermoplastic elastomers, such as a known ionomer resin or polyurethane.

(A) Ionic Resin

The ionic resin serving as component A is the primary ingredient in the intermediate layer-forming resin composition, and must have a weight-average molecular weight (Mw) of at least 40,000 and a weight-average molecular weight (Mw) to number-average molecular weight (Mn) ratio (Mn/Mw) of at least 3.0. Moreover, at least 70 wt % of unsaturated carboxylic acid present therein must be neutralized with metal cations. Specifically, preferred use may be made of ionic resins such as olefin-unsaturated carboxylic acid copolymers and olefin-unsaturated carboxylic acid-carboxylic acid ester copolymers. Any one of these ionic resins may be used singly or two or more may be used together. It is also possible to use these ionic resins in combination with another thermoplastic resin, the inclusion of a thermoplastic polyurethane or a thermoplastic elastomer being especially preferred.

Here, the weight-average molecular weight (Mw) of component (A) is at least 40,000. The upper limit may be set to preferably 300,000 or less, and more preferably 250,000 or less. The weight-average molecular weight (Mw) to number-average molecular weight (Mn) ratio of the copolymer is at least 3.0. The upper limit in the ratio may be set to preferably 15.0 or less, and more preferably 12.0 or less.

In component A, it is critical for at least 70 wt % of the unsaturated carboxylic acid included in the copolymer to be neutralized with metal cations, and it is recommended that preferably at least 75 wt %, and more preferably at least 80 wt %, of the unsaturated carboxylic acid be neutralized with metal cations. Component A may be obtained by neutralizing some or all of the acid groups in the above respective copolymers with metal ions.

The metal ions which neutralize acid groups in the copolymer are exemplified by $Na^+$, $K^+$, $Li^+$, $Zn^{++}$, $Cu^{++}$, $Mg^{++}$, $Ca^{++}$, $Co^{++}$, $Ni^{++}$ and $Pb^{++}$. In the present invention, of these, the use of $Na^+$, $Li^+$, $Zn^{++}$ and $Mg^{++}$ is more preferred, with $Mg^{++}$ and $Zn^{++}$ being especially recommended. Neutralization products such as the above may be obtained by a know method. For example, compounds such as formates, acetates, nitrates, carbonates, bicarbonates, oxides, hydroxides and alkoxides of the above metal ions may be used and introduced to the above copolymer.

A commercial product may be used as above component A. Illustrative examples include the products available under the trade names HIMILAN 1601, HIMILAN 1605, HIMILAN 1557 and HIMILAN 1855 (all from DuPont-Mitsui Polychemicals), and the products available under the trade names IOTEK 8030 and IOTEK 7010 (from ExxonMobil).

(B) Thermoplastic Resin Other than Component A

Component B is a thermoplastic resin other than component A, and is an ingredient which is preferably included so as to further improve both the feel of the golf ball on impact and the rebound. This component B may be a known substance. In the present invention, the use of an olefinic thermoplastic resin is especially preferred. The olefinic thermoplastic resin may be of one type used alone or may be of two or more types used together. In cases where two or more types are included together, it is preferable to use in combination both a thermoplastic polyurethane and a thermoplastic elastomer.

Commercial products may be used as the thermoplastic polyurethane and the thermoplastic elastomer. Specific examples include the product available under the trade name PANDEX T-R3080 (from DIC Bayer Polymer), and the products available under the trade names DYNARON 6100 and DYNARON 4630P (JSR Corporation).

The compounding ratio of above components A and B, expressed as the weight ratio A/B, is from 100/0 to 10/90, and preferably from 90/10 to 50/50.

(C-1) Color Pigment or Dye

The color pigment or dye serving as component C-1 is included for the purpose of adjusting the color of the ball. In the practice of the invention, a known color pigment or dye may be used. From the standpoint of resistance to discoloration, it may be preferable to use a pigment. The color pigment or dye is suitably selected from the group consisting of red pigments and dyes, blue pigments and dyes, yellow pigments and dyes, green pigments and dyes, violet pigments and dyes, and black pigments and dyes. Exemplary red pigments and dyes include pigments and dyes based on quinacridones, perylenes and anthraquinones; exemplary blue pigments and dyes include pigments and dyes based on phthalocyanines, and ultramarine pigments; exemplary yellow pigments and dyes include mixed oxide pigments, polyazo pigments and dyes, and heterocyclic pigments and dyes; exemplary violet pigments and dyes include ultramarine violet; and black pigments and dyes include carbon black. By including these, it is possible to express a color having a sense of elegance. These color pigments or dyes may be of one type used alone or may be of two or more types used together; the combinations or included amounts of the color pigments or dyes may be suitably selected according to the ball specifications and other considerations. Commercial products may be used as the color pigment or dye. Specific examples of such commercial products include those available under the trade names CHROMOFINE (Dainichi Seika Color & Chemicals Mfg. Co., Ltd.), TIPAQUE YELLOW (Ishihara Sangyo Kaisha, Ltd.) and TOKABLACK (Tokai Carbon Co., Ltd.). The amount in which component C-1 is included per 100 parts by weight of above components A and B combined may be set to 5 parts by weight or less (from 0 to 5 parts by weight), preferably from 0.001 to 5 parts by weight, and more preferably from 0.01 to 4.5 parts by weight. When the amount of component C-1 added is too low, coloration may be poor. When too much is added, coloration may be excessive, resulting in loss of the sense of quality and elegance.

(C-2) Color Masterbatch

In cases where the outermost layer has a rather light hue with a sense of transparency, there are times where, in spite of a desire to express a subtle hue, the color of the intermediate layer affects the golf ball as a whole. In such cases, it is effective to uniformly disperse the pigment or dye within the material. To improve the dispersibility of the color pigment or dye, prior to mixture with components A and B, it is effective to first blend the color pigment or dye with a known resin and additives so as to prepare a color masterbatch (C-2), and to then compound the masterbatch with components A and B.

The above color masterbatch (C-2) is described in detail below.

In the invention, component C-2 may be prepared by blending the above color pigment or dye with a known resin and additives. Although not subject to any particular limitation, preferred use may be made of a resin composition which includes the following ingredients:

(m) 100 parts by weight of a thermoplastic resin, (n) 0.1 to 200 parts by weight of titanium oxide, (o) 0.1 to 10 parts by weight of a color pigment or dye, and (p) 0.1 to 20 parts by weight of a lubricant.

The thermoplastic resin used as component (m) may be a known resin. Although not subject to any particular limitation, it is preferable to use a resin similar to those of components A and B.

The titanium oxide used as component (n) may be a known titanium oxide. For example, preferred use may be made of the products commercially available under the trade name TIPAQUE (from Ishihara Sangyo Kaisha). The amount included per 100 parts by weight of above component (m) may be set to from 0.1 to 200 parts by weight, and preferably from 0.1 to 180 parts by weight.

The color pigment or dye used as component (o) may be similar to the color pigment or dye described above. In this case, the amount of component (o) included per 100 parts by weight of component (m) may be set to from 0.1 to 10 parts by weight, and preferably from 0.1 to 7 parts by weight.

The lubricant used as component (p) may be a known lubricant. Although not subject to any particular limitation, preferred use may be made an unsaturated carboxylic acid metal salt (e.g., magnesium stearate) or polyethylene wax. The amount of component (p) included per 100 parts by weight of component (m) may be set to from 0.1 to 20 parts by weight, and preferably from 0.5 to 15 parts by weight.

The color masterbatch may be prepared by a known method. For example, it may be obtained by mixture using a mixing apparatus selected from among twin-screw/single-screw extruders (including kneader-extruders) equipped with a pressurizing kneader and a force feeder, tandem extruders, and twin-screw extruders. When component C-2 is added to the intermediate layer-forming resin composition, the amount of such addition per 100 parts by weight of components A and B combined is from 1 to 20 parts by weight, and preferably from 3.5 to 15 parts by weight. If the amount of color masterbatch added is too small, the color of the ionic resin may emerge intact at the outermost layer, which may give the overall ball a dark cast. On the other hand, if the amount of addition is too large, this may have an adverse effect on the physical properties themselves, such as making the weight of the ball too heavy.

(D) Additives

In addition to each of the above ingredients, various additives may also be included as an additional component D. Additives for various resin applications may be used, such as antioxidants, ultraviolet absorbers, lubricants, flow enhancers and thickeners. Additives such as organic acids and salts thereof, and basic inorganic metal compounds, may also be suitably used for the purpose of enhancing the functionality of component A. These additives are included in an amount which may be suitably selected within a range that does not adversely affect the moldability and other properties of the resin composition. Although not subject to any particular limitation, the amount of addition may be set to from 0.1 to 5 parts by weight, and preferably from 0.1 to 4 parts by weight, per 100 parts by weight of components A and B combined.

The intermediate layer 2 has a thickness which may be suitably set according to the ball specifications and is not subject to any particular limitation. The thickness may be set to from 0.5 to 2 mm, and preferably from 0.75 to 1.8 mm. If the thickness of the intermediate layer 2 is too small, the golf ball durability may be poor and the color of the core may exert an influence on the color of the ball surface, which is undesirable. On the other hand, if the thickness is too large, molding may be difficult and there is a possibility that color irregularities will arise.

Preparation of the above-described intermediate layer-forming resin composition may be carried out using a known mixing apparatus, such as a single-screw extruder or a twin-screw extruder. In this invention, the use of a twin-screw extruder is preferred. Alternatively, these extruders may be used in a tandem arrangement, such as single-screw extruder/twin-screw extruder or twin-screw extruder/twin-screw extruder. These extruders need not be of a special design; the use of existing extruders will suffice. The method of molding the intermediate layer using the above resin composition is not subject to any particular limitation. For example, use may be made of an injection molding process or a compression molding process. In cases where an injection molding process is used, the process may be one in which a prefabricated core is placed at a predetermined position in an injection mold, following which the resin composition is introduced into the mold. Alternatively, in cases where a compression-molding process is used, the process may be one in which a pair of half-cups is fashioned from the above resin composition, the cups are placed over core, and heat and pressure are applied in a mold. When molding is carried out under applied heat and pressure, the molding conditions employed may be a temperature of from 120 to 170° C. and a molding time of from 1 to 5 minutes.

The outer cover layer (outermost layer) 3 is formed of a resin composition which contains as the essential ingredients: (a) a thermoplastic resin, (b) a fluorescent color-containing color pigment and/or dye, and (c) titanium oxide. The ingredients of the outer cover layer (outermost layer)-forming resin composition are each described in detail below.

(a) Thermoplastic Resin

The thermoplastic resin serving as component (a) is the primary ingredient in the outermost layer-forming resin composition. Various known thermoplastic resins may be used without particular limitation. Specifically, preferred use may be made of an olefinic thermoplastic resin. Of these, the use of ionic resins and nonionic resins of, for example, olefin-unsaturated carboxylic acid copolymers and olefin-unsaturated carboxylic acid-carboxylic acid ester copolymers is more preferred. Any one of these may be used alone or two or more may be used together. Alternatively, such resins may be used in combination with another thermoplastic resin. Of the latter, preferred use may be made of a thermoplastic polyurethane or a thermoplastic elastomer.

Although above component (a) is not subject to any particular limitation, use may be made of a known thermoplastic resin. Illustrative examples of ionic resins include those available under the trade names HIMILAN 1601, HIMILAN 1605, HIMILAN 1557 and HIMILAN 1855 (all products of DuPont-Mitsui Polychemicals), and those available under the trade names IOTEK 8030 and IOTEK 7010 (from ExxonMobil). Illustrative examples of nonionic resins include that available under the trade name NUCREL N035C (DuPont-Mitsui Polychemicals).

The above-mentioned thermoplastic polyurethane and thermoplastic elastomer are not subject to any particular limitation. Use may be made of a known product, illustrative examples of which include that available under the trade name PANDEX T-R3080 (from DIC Bayer Polymer), and those available under the trade names DYNARON 6100 and DYNARON 4630P (JSR Corporation).

(b) Fluorescent Color-Containing Color Pigment and/or Dye

The fluorescent color-containing color pigment and/or dye serving as component (b) is included for the purpose of adjusting the color of the ball. In the invention, a known color pigment or dye may be used as this component (b). From the standpoint of resistance to discoloration (weatherability), the use of a pigment is preferred. The above color pigment and/or dye may be suitably selected from the group consisting of red pigments and dyes, blue pigments and dyes, yellow pigments and dyes, green pigments and dyes, violet pigments and dyes, and black pigments and dyes. Exemplary red pigments and dyes include pigments and dyes based on quinacridones, perylenes and anthraquinones; exemplary blue pigments and dyes include pigments and dyes based on phthalocyanines, and ultramarine pigments; exemplary yellow pigments and dyes include mixed oxide pigments, polyazo pigments and dyes, and heterocyclic pigments and dyes; exemplary violet pigments and dyes include ultramarine violet; and black pigments and dyes include carbon black. By including these, it is possible to express a color having a sense of elegance. Such fluorescent color-containing color pigments and/or dyes may be of one type used alone or may be two or more types used together. Combinations thereof may be suitably selected according to the ball specifications and other considerations, provided at least one of the pigments and/or dyes in the combination has a fluorescent color. Commercial products may be used as the above color pigment and/or dye. Specific examples of such commercial products include those available under the trade names CHROMOFINE (Dainichi Seika Color & Chemicals Mfg. Co., Ltd.), TIPAQUE YELLOW (Ishihara Sangyo Kaisha, Ltd.) and TOKABLACK (Tokai Carbon Co., Ltd.). The amount in which component (b) is included per 100 parts by weight of above component (a) may be set to 5 parts by weight or less (0 to 5 parts by weight), preferably from 0.001 to 5 parts by weight, and more preferably from 0.01 to 4.5 parts by weight. When the amount of component (b) added is too low, coloration may be poor. When too much is added, coloration may be excessive, resulting in a loss of the sense of quality and elegance.

(c) Titanium Oxide

The titanium oxide serving as component (c) is included for the purpose of controlling the hideability of the outermost layer-forming resin composition. In the practice of the invention, by adjusting the amount of titanium oxide included, the extent to which the underlying layer shows through can be changed, in addition to which the degree of coloration can be varied. A known titanium oxide may be used in the invention. For example, preferred use may be made of products commercially available under the trade name TIPAQUE (Ishihara Sangyo Kaisha). This titanium oxide may also be used as a white pigment, enabling depth to be imparted to the color of the ball. The amount in which component (c) is included per 100 parts by weight of component (a) may be set to 0.45 part by weight or less (from 0 to 0.45 part by weight), preferably 0.3 part by weight or less, and more preferably 0.25 part by weight or less. The lower limit, although not subject to any particular limitation, is preferably at least 0.01 part by weight per 100 parts by weight of component (a). The addition of too much component (c) may increase the sense of opacity, lowering the luminance and resulting in a loss of the sense of quality and elegance.

(d) Additives

In addition to above components (a) to (c), it is possible to include also various types of additives as component (d). Additives for various resin applications may be used, such as antioxidants, ultraviolet absorbers, lubricants, flow enhancers and thickeners. Additives such as organic acids and salts thereof, and basic inorganic metal compounds may also be suitably used for the purpose of enhancing the functionality of component (a). These additives are included in an amount which may be suitably selected within a range that does not adversely affect the moldability and other properties of the resin composition. Although not subject to any particular limitation, the amount of addition may be set to from 0.1 to 50 parts by weight, and preferably from 0.1 to 40 parts by weight, per 100 parts by weight of component (a).

The outermost layer 3 formed using the resin composition formulated from the above ingredients, although not subject to any particular limitation, may be set to a thickness of from 0.3 to 3 mm, and preferably from 0.5 to 2.5 mm. If the thickness of the outermost layer 3 is too small, the underlying material may show through, detracting from the ball coloration. On the other hand, if the thickness is too large, uniform injection molding may be difficult to carry out, resulting in a loss in the sense of quality of the ball as a whole.

The luminance of the outermost layer-forming resin composition is suitably selected in accordance with the color of the ball, and may be set to from 5 to 100 cd/m$^2$, and preferably from 10 to 85 cd/m$^2$. With yellow golf balls in particular, because there is a tendency for the color to feel subdued, a luminance of from 50 to 100 cd/m$^2$ is preferred. For golf balls in colors other than yellow (e.g., orange, pink, blue, violet, white, green, red), a brightness of from 5 to 50 cd/m$^2$ is preferred. As used herein, "luminance" is a psychophysical measure expressing the amount of brightness sensed by a human being. A large value indicates what a person would sense as "bright"; conversely, a small value indicates what a person would sense as "dark."

The outermost layer-forming resin composition has a haze of at least 75 but not more than 100, and preferably at least 80 but not more than 100. If the haze value is too low, the elegant appearance of the ball may be lost. The total light transmittance is at least 5.0 but not more than 80, and preferably at least 5.5 but not more than 75. If the total light transmittance is too large, the transparency may be excessive, as a result of which the sense of elegance may be compromised. The diffusion transmittance is at least 0.05 but not more than 80, and preferably at least 1.0 but not more than 75. If the diffusion transmittance is too large, the transparency may be excessive, as a result of which the sense of elegance may be compromised.

As used herein, "total light transmittance" and "diffuse transmittance" refer respectively to the proportion (%) of light that is transmitted and the proportion (%) of light that is diffused when light from a light source is applied through a plastic (outermost layer-forming resin composition) test specimen. Both values are obtained in general accordance with JIS K7105 (1981).

"Haze" refers to a value computed by the following formula from the above total light transmittance and diffuse transmittance. For further details, reference should be made to JIS K7136 (2000).

$$\text{Haze (\%)} = (\text{diffusion transmittance } T_d)/(\text{total light transmittance } T_t) \times 100$$

In the above description, a larger total light transmittance indicates that light passes through more easily and that the degree of transparency is higher; conversely, a smaller value indicates that light passes through with greater difficulty and that the degree of transparency is lower. In the case of both diffuse transmittance and haze, smaller values indicate a greater degree of clouding; conversely, larger values indicate less light diffusion and a higher degree of transparency.

Preparation of the outermost layer-forming resin composition may be carried out using a known mixing apparatus, such as a single-screw extruder or a twin-screw extruder. In this invention, the use of a twin-screw extruder is preferred. Alternatively, these extruders may be used in a tandem arrangement, such as single-screw extruder/twin-screw extruder or twin-screw extruder/twin-screw extruder. These extruders need not be of a special design; the use of existing extruders will suffice. The method of molding the cover using the outermost layer-forming resin composition is not subject to any particular limitation. For example, use may be made of an injection molding process or a compression molding process. In cases where an injection molding process is used, the process may be one in which an intermediate layer-covered sphere obtained by encasing the above-described core in the above-described intermediate layer is placed at a predetermined position in an injection mold, following which the outermost layer-forming resin composition is introduced into the mold. Alternatively, in cases where a compression-molding process is used, the process may be one in which a pair of half-cups is fashioned from the outermost layer-forming resin composition, the cups are placed over an intermediate layer-covered sphere, and heat and pressure are applied in a mold. When molding is carried out under applied heat and pressure, the molding conditions employed may be a temperature of from 120 to 170° C. and a molding time of from 1 to 5 minutes.

As shown in FIG. 1, the surface of the outermost layer 3 is covered with a coat of paint 4. The thickness of this paint coat 4, although not subject to any particular limitation, is preferably at least 5 μm, and more preferably at least 10 μm, but preferably not more than 20 μm, and more preferably not more than 16 μm. If the paint coat 4 is too thin, the durability of the coat may be inadequate. On the other hand, if the paint coat 4 is too thick, the rebound of the ball may decrease and peeling of the paint may occur.

This paint coat 4 is formed by applying a paint composed of a base resin such as polyurethane to which a polarizing pigment and various solvents and additives have been suitably added. The paint coat 4 has a sense of transparency owing to synergistic effects with the color of the outermost layer 3, thereby enabling a color having a sense of elegance to be obtained.

The base resin of the paint may be, for example, a known urethane resin. Although not subject to any particular limitation, in this invention, the use of a two-part curing urethane paint composed of a polyol component having hydroxyl groups and a polyisocyanate component having isocyanate groups is preferred. Examples of polyols that may be primarily used include urethanes, polyesters and acrylic resins, although other resins, such as epoxy resins, may be employed if necessary. Examples of polyisocyanates that may be used include tolylene diisocyanate, diphenylmethane-4,4'-diisocyanate, hexamethylene diisocyanate, isophorone diisocyanate, naphthalene diisocyanate, 1,4-phenylene diisocyanate, xylylene diisocyanate and hydrogenated xylylene diisocyanate, either singly or in modified forms as combinations of two or more thereof. The polyisocyanate component may generally take the form of an adduct, a biuret or an isocyanurate.

The polarizing pigment is included for the purpose of enhancing the elegant feel and sense of quality of the golf ball. For example, metal powder pigments, glass flakes, mica and pearlescent pigments may be included. In the present invention, the use of a pearlescent pigment is especially preferred. Any of the following may be used as the pearlescent pigment: metal oxide-coated mica, basic lead carbonate, bismuth oxychloride, and natural pearl essence. Of these, the selection of a metal oxide-coated mica is preferred because such pigments are nontoxic and have the best chemical stability. In such a metal oxide-coated mica, titanium dioxide or iron oxide is typically used as the metal oxide which coats the mica; by varying the coverage (thickness of the coating layer), various colors and interference effects can be achieved. The particle size of the polarizing pigment is not subject to any particular limitation. However, the pigment has a greater tendency to settle at a larger particle size; hence, it is desirable to select a pigment having a suitable particle site. A commercial product may be used as the above polarizing pigment. Examples of such products are the polarizing pigments available under the trade name XIRALLIC (from Merck Japan).

The amount of polarizing pigment included per 100 parts by weight of the base resin may be set in a range of 3 parts by weight or less (from 0 to 3 parts by weight), preferably from 0.1 to 3 parts by weight, and more preferably from 0.2 to 2 parts by weight. If the amount of polarizing pigment is too low, a suitable brightness and luminance will be lost, as a result of which a sense of quality and elegance may not be achieved. On the other hand, including too much polarizing pigment may make the painting operation more difficult or may become a major cause in peeling of the paint coat.

In addition, to increase the brightness of the paint, it is preferable to include a fluorescent whitener. The amount of fluorescent whitener included per 100 parts by weight of the base resin may be set to from 0.05 to 1 part by weight, and is more preferably used in such a way that the ratio between the amount of fluorescent whitener and the amount of polarizing pigment included (fluorescent whitener/polarizing pigment), expressed as a weight ratio, is from 0.05 to 5.0.

Any known method used in the art may be employed as the method for applying the paint. For example, the entire ball may be spray-painted while perched on the tips of needles on a needle bed. Alternatively, prior to painting, to improve adhesion between the object to be painted (a sphere covered by the outermost layer 3) and the paint coat 4, although not subject to any particular limitation, surface modification by plasma treatment or corona discharge treatment may be carried out, or a primer or the like may be applied.

The golf ball of the invention, which can be manufactured so as to conform with the Rules of Golf for competitive play, may be produced to a ball diameter which is not less than 42.67 mm and to a weight which is not more than 45.93 g.

EXAMPLES

The following Examples are provided to illustrate the invention, and are not intended to limit the scope thereof.

Examples 1 to 7, Comparative Examples 1 to 3

A rubber composition having a common formulation for the examples of the invention and the comparative examples was prepared, kneaded in a kneader or roll mill, then fashioned under specific vulcanization conditions into a core having a diameter of 37.0 mm. Next, in each example, the intermediate layer-forming resin composition shown in Table 1 was injection-molded over the resulting core to form an intermediate layer having a thickness of 1.5 mm, following which the outermost layer-forming resin composition shown in Table 1 was injection-molded to form an outermost layer having a thickness of 1.3 mm. A two-part curing urethane paint of the following formulation was then spray-painted onto the surface of the ball and dried to from a paint coat (thickness, 20 μm), thereby producing colored golf balls in the respective examples of the invention and comparative examples. The numbers in the resin mixing material formulations shown in Table 1 indicate parts by weight. Although not described here in further detail, in each of the examples of the invention and the comparative examples, numerous dimples were formed in an identical arrangement on the surface of the golf ball.

Rubber Formulation

| | |
|---|---|
| Polybutadiene rubber | 100 parts by weight |
| Zinc acrylate | 29 parts by weight |
| Peroxide | 1.2 parts by weight |
| Antioxidant | 0.1 part by weight |
| Zinc oxide | 26.7 parts by weight |
| Zinc salt of pentachlorothiophenol | 0.2 part by weight |
| Red pigment | 0.08 part by weight |

Vulcanization of the above rubber was carried out at 155° C. for 15 minutes. The peroxide was a mixture of 1,1-di(t-butylperoxy)cyclohexane and silica that is available under the trade name PERHEXA C-40 (from NOF Corporation). The antioxidant was NOCRAC NS-6 (Ouchi Shinko Chemical Industry Co., Ltd.).

Paint Formulation

| | |
|---|---|
| Base resin | 98.5 wt % |
| Polarizing pigment | 1.0 wt % |
| Fluorescent whitener | 0.5 wt % |

Details of the above materials are provided below.

Base resin: two-part curing urethane paint

Polarizing pigment: Available from Merck under the trade name IRIODIN.

The physical properties of the covers and golf balls obtained as described above in the respective examples of the invention and comparative examples were rated according to the following criteria. The results are shown in Table 1.

Luminance

The luminance was measured in general accordance with JIS 28722 and JIS 28717 using a luminance meter (LS-110, from Konica Minolta). A darkroom was used to shield out the influence of other light. An ordinary fluorescent light (type 20, 18 W, 1220 lm) was used as the light source directed at the object, and was set so that the light falls uniformly on the object.

Total Light Transmittance and Diffusion Transmittance

Measurement was carried out under the following conditions using a light transmittance measuring instrument (TURBIDIMETER NDH5000W, manufactured by Nippon Denshoku Industries Co., Ltd.). The total light transmittance and diffuse transmittance were measured in general accordance with JIS K7105, and the haze was determined in general accordance with JIS K7136.

Measurement conditions: Light source, D65; measurement method, 3

Number of measurements: n=3 for each sample

The total light transmittance and the diffuse transmittance were obtained by directing the light source at a test specimen, measuring how much of the light passed through the test specimen and how much diffused through the test specimen, and converting the results to numerical values. Larger values indicate a higher degree of transparency, and smaller values indicate a lower degree of transparency. Normally, when these measurements are carried out on a resin composition containing titanium oxide, the values obtained are substantially 0.

Weatherability

Each type of ball (n=3) was exposed to sunlight together with an index ball. ΔE was measured at fixed time intervals with a Lab color difference meter. When the ΔE of the index ball became 15 or more, exposure to sunlight was stopped, and the ΔE for each ball at that time was measured. The weatherability was rated according to the following ΔE criteria.

Excellent: less than 5

Good: 5 or more, but less than 13

Fair: 13 or more

Sense of Elegance

Sensory evaluations based on the following criteria were carried out by ten skilled golfers.

Excellent: Eight or more of the ten golfers thought the ball had an elegant feel.

Good: Five to seven of the ten golfers thought the ball had an elegant feel.

Fair: Three or four of the ten golfers thought the ball had an elegant feel.

NG: Two or less of the ten golfers thought the ball had an elegant feel.

Sense of Brightness

Sensory evaluations based on the following criteria were carried out by ten skilled golfers.

Excellent: Eight or more of the ten golfers thought the ball had a bright feel.

Good: Five to seven of the ten golfers thought the ball had a bright feel.

Fair: Three or four of the ten golfers thought the ball had a bright feel.

NG: Two or less of the ten golfers thought the ball had a bright feel.

Initial Velocity

The initial velocity was measured using a USGA drum rotation-type initial velocity instrument, which is an apparatus approved by the R&A. The balls were held isothermally at a temperature of 23±1° C. for at least 3 hours, then tested in a room temperature (23±2° C.) chamber. One dozen balls were each hit twice, and the time taken for the balls to traverse a distance of 6.28 ft (1.91 m) was measured and used to compute the initial velocity.

TABLE 1

| | | Example | | | | | | | Comparative Example | | |
|---|---|---|---|---|---|---|---|---|---|---|---|
| | | 1 | 2 | 3 | 4 | 5 | 6 | 7 | 1 | 2 | 3 |
| Outermost layer formulation | Color Pigment or dye | yellow pigment | yellow pigment/ perylene dye | yellow pigment | orange pigment | orange pigment | pink pigment/ anthra-quinone dye | yellow hetero-cyclic dye | yellow mixed oxide pigment | yellow pigment | black carbon black |
| | Amount of pigment or dye | 1.6 | 0.1 | 0.1 | 0.9 | 1.4 | 0.2 | 1.0 | 1.0 | 2.0 | 1.0 |
| | Himilan 1557 | 50 | 50 | | 50 | 50 | | | | 50 | |
| | Himilan 1601 | 50 | 50 | | 50 | 50 | | | | 50 | |
| | Himilan 1855 | | | 50 | | | 50 | 50 | 50 | | 50 |
| | Himilan 1555 | | | 50 | | | 50 | 50 | 50 | | 50 |
| | Titanium oxide | 0.04 | 0.04 | | 0.04 | 0.04 | | | 0.8 | 0.04 | |
| | Magnesium stearate | 1.0 | 1.0 | 1.0 | 1.0 | 1.0 | 1.0 | 1.0 | 1.0 | 1.0 | 1.0 |
| | Polyethylene wax | 1.0 | 1.0 | 1.0 | 1.0 | 1.0 | 1.0 | 1.0 | 1.0 | 1.0 | 1.0 |
| Intermediate layer formulation | Ionic resin | 100 | 100 | 90 | 100 | 90 | 90 | 100 | 100 | | 100 |
| | Thermoplastic resin (1) | | | 10 | | 10 | 10 | | | | |
| | Thermoplastic resin (2) | | | | | | | | | 100 | |
| | Colorant | | | 0.01 | | 0.02 | 0.01 | | | | |
| | Color masterbatch | 5 | 5 | | 5 | | | 5 | 5 | | 5 |

TABLE 1-continued

| | | Example | | | | | | | Comparative Example | | |
|---|---|---|---|---|---|---|---|---|---|---|---|
| | | 1 | 2 | 3 | 4 | 5 | 6 | 7 | 1 | 2 | 3 |
| Properties of outermost layer-forming composition | HAZE | 98.63 | 81.5 | 98.55 | 97.22 | 98.00 | 96.09 | 98.55 | 98.5 | 83.3 | 80.9 |
| | Total light transmittance | 59.64 | 67.84 | 64.16 | 38.19 | 36.10 | 50.39 | 64.16 | 8.52 | 58.4 | 2.2 |
| | Diffusion transmittance | 58.83 | 55.29 | 63.23 | 38.01 | 38.47 | 48.42 | 63.23 | 8.4 | 56.21 | 56.2 |
| Ball appearance | Luminance | 59.63 | 56.86 | 55.07 | 23.12 | 32.24 | 21.54 | 70.33 | 42.96 | 69.95 | 0.64 |
| | Weatherability | Exc. | Good | Exc. | Exc. | Exc. | Good | Fair | Exc. | Exc. | Exc. |
| | Sense of elegance | Exc. | Exc. | Good | Good | Good | Good | Good | NG | Exc. | NG |
| | Sense of brightness | Exc. | Exc. | Good | Exc. | Good | Good | Good | Fair | Exc. | NG |
| | Initial velocity | 77.10 | 77.07 | 77.21 | 77.06 | 77.11 | 77.15 | 77.18 | 77.15 | 76.94 | 77.10 |

The materials mentioned in the table are described below.

Outermost Layer-Forming Resin Composition

Himilan 1557: Zinc-neutralized ethylene-methacrylic acid copolymer available from DuPont-Mitsui Polychemicals Co., Ltd.

Himilan 1601: Sodium-neutralized ethylene-methacrylic acid copolymer available from DuPont-Mitsui Polychemicals Co., Ltd.

Himilan 1855: Zinc-neutralized ethylene-methacrylic acid-acrylic acid ester copolymer available from DuPont-Mitsui Polychemicals Co., Ltd.

Himilan 1555: Sodium-neutralized ethylene-methacrylic acid copolymer available from DuPont-Mitsui Polychemicals Co., Ltd.

Titanium oxide: Available from Ishihara Sangyo Kaisha

Intermediate Layer-Forming Resin Composition

Ionic resin: Magnesium-neutralized ethylene-acrylic acid-acrylic acid ester copolymer available under the trade name HPF 1000 from E.I. DuPont de Nemours & Co.

Thermoplastic Resin (1): Polyester elastomer available under the trade name HYTREL 4001 from DuPont-Toray Co., Ltd.

Thermoplastic Resin (2): Thermoplastic olefin elastomer available under the trade name DYNARON 6100 from JSR Corporation Color Masterbatch: A resin composition containing the following ingredients.

| | |
|---|---|
| Thermoplastic resin | 100 parts by weight |
| Titanium oxide | 60 parts by weight |
| Pigment | 1.7 parts by weight |
| Lubricant | 5.0 parts by weight |

The thermoplastic resin used in the color masterbatch was NUCREL N1050H, available under this trade name from DuPont-Mitsui Polychemicals Co., Ltd.; the titanium oxide was available under the trade name TIPAQUE from Ishihara Sangyo Kaisha, and the lubricant was magnesium stearate.

Japanese Patent Application No. 2010-255109 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A colored golf ball comprising a core, a cover of two or more layers encasing the core, and a coat of paint applied to a surface of an outermost layer of the cover, wherein the outermost cover layer is formed of a resin composition comprising:

(a) 100 parts by weight of a thermoplastic resin, (b) 5 parts by weight or less of a fluorescent color-containing color pigment and/or dye, and (c) 0.45 part by weight or less of titanium oxide;

a layer adjoining an inner side of the outermost layer is formed of a resin composition comprising:

100 parts by weight of a resin component which includes (A) an ionic resin having a weight-average molecular weight (Mw) of at least 40,000 and a weight-average molecular weight (Mw) to number-average molecular weight (Mn) ratio (Mn/Mw) of at least 3.0, and having at least 70 wt % of unsaturated carboxylic acid present therein neutralized with metal cations, and (B) a thermoplastic resin other than component A in a component A to component B weight ratio (A/B) of from 100/0 to 10/90, and (C-1) 5 parts by weight or less of a color pigment or dye, and/or (C-2) from 1 to 20 parts by weight of a color masterbatch; and the ball has a surface luminance of from 5 to 100 cd/m$^2$, wherein the paint coat comprises 100 parts by weight of a base resin, from 0.05 to 1 part by weight of a fluorescent whitener and 3 parts by weight or less of a polarizing pigment, and the fluorescent whitener and polarizing pigment have a weight ratio therebetween of from 0.05 to 5.0.

2. The colored golf ball of claim 1, wherein the color pigment or dye (b) is selected from the group consisting of red pigments and dyes, blue pigments and dyes, yellow pigments and dyes, green pigments and dyes, violet pigments and dyes, and black pigments and dyes.

3. The colored golf ball of claim 1, wherein the surface luminance of the ball is from 10 to 85 cd/m$^2$.

4. The colored golf ball of claim 1, wherein the outermost layer-forming resin composition has a haze of from 75 to 100.

5. The colored golf ball of claim 1, wherein the outermost layer-forming resin composition has a total light transmittance of from 5.0 to 80.

6. The colored golf ball of claim 1, wherein the outermost layer-forming resin composition has a diffuse transmittance of from 0.05 to 80.

7. A colored golf ball comprising a core, a cover of two or more layers encasing the core, and a coat of paint applied to a surface of an outermost layer of the cover, wherein the outermost cover layer is formed of a resin composition comprising:

(a) 100 parts by weight of a thermoplastic resin, (b) 5 parts by weight or less of a fluorescent color-containing color pigment and/or dye, and (c) 0.45 part by weight or less of titanium oxide;

a layer adjoining an inner side of the outermost layer is formed of a resin composition comprising:

100 parts by weight of a resin component which includes (A) an ionic resin having a weight-average molecular weight (Mw) of at least 40,000 and a weight-average molecular weight (Mw) to number-average molecular weight (Mn) ratio (Mn/Mw) of at least 3.0, and having at least 70 wt % of unsaturated carboxylic acid present therein neutralized with metal cations, and (B) a thermoplastic resin other than component A in component A to component B weight ratio (A/B) of from 90/10 to 50/50, and (C-1) 5 parts by weight or less of a color pigment or dye, and/or (C-2) from 1 to 20parts by weight of a color masterbatch; and the ball has a surface luminance of from 5 to 100 cd/m$^2$, wherein Component B is one or more selected from the group consisting of a thermoplastic polyurethane, a polyester elastomer and an olefinic thermoplastic resin other than an ionic resin; and wherein the paint coat comprises 100 parts by weight of a base resin, from 0.05 to 1 part by weight of a fluorescent whitener and 3 parts by weight or less of a polarizing pigment, and the fluorescent whitener and polarizing pigment have a weight ratio therebetween of from 0.05 to 5.0.

8. The colored golf ball of claim 7, wherein the color pigment or dye (b) is selected from the group consisting of red pigments and dyes, blue pigments and dyes, yellow pigments and dyes, green pigments and dyes, violet pigments and dyes, and black pigments and dyes.

9. The colored golf ball of claim 7, wherein the surface luminance of the ball is from 10 to 85 cd/m$^2$.

10. The colored golf ball of claim 7, wherein the outermost layer-forming resin composition has a haze of from 75 to 100.

11. The colored golf ball of claim 7, wherein the outermost layer-forming resin composition has a total light transmittance of from 5.0 to 80.

12. The colored golf ball of claim 7, wherein the outermost layer-forming resin composition has a diffuse transmittance of from 0.05 to 80.

* * * * *